United States Patent [19]

Shaw et al.

[11] 4,388,048

[45] Jun. 14, 1983

[54] STEPPING TYPE UNLOADING SYSTEM FOR HELICAL SCREW ROTARY COMPRESSOR

[75] Inventors: David N. Shaw, Unionville; Joseph A. L. N. Gagnon, Windsor Locks, both of Conn.

[73] Assignee: Dunham Bush, Inc., West Hartford, Conn.

[21] Appl. No.: 242,100

[22] Filed: Mar. 10, 1981

[51] Int. Cl.[3] ..... F04B 49/00; F01C 1/16

[52] U.S. Cl. ..... 417/310; 417/299; 418/201

[58] Field of Search ..... 417/299, 310, 440, 441; 418/201, 159; 91/519, 520, 525

[56] References Cited

U.S. PATENT DOCUMENTS 3,432,089 3/1969 Schibbye ..... 418/201

*Primary Examiner*—John J. Camby

*Attorney, Agent, or Firm*—Sughrue, Mion, Zinn, Macpeak and Seas

[57] ABSTRACT

A stepping piston is projected into the path of a slide valve drive piston to limit piston movement and thus the slide valve towards maximum unload position determined by piston bottoming out against the cylinder wall. The slide valve main drive piston stroke is also correlated to desired slide valve positions along the intermeshed helical screw rotors of the helical screw rotary compressor to provide, for example, stepped unloading at compressor full load, two-thirds full load, and one-third full load.

4 Claims, 3 Drawing Figures

STEPPING TYPE UNLOADING SYSTEM FOR HELICAL SCREW ROTARY COMPRESSOR

BACKGROUND OF THE INVENTION

This invention relates to helical screw rotary compressors, and more particularly, to an improved stepping type unloading system for controlling compressor capacity and discharge pressure of the machine by stepping of a screw compressor capacity control slide valve.

DESCRIPTION OF THE PRIOR ART

One form of positive displacement gas compressor is the helical screw rotary compressor in which a gaseous working fluid is trapped within the closed threads of intermeshed helical screw rotors defining a decreasing volume working chamber. The helical screw rotors are mounted for rotation within intersecting bores with coplanar axes defining the barrel portion of a screw compressor casing. Conventionally, to control the capacity of the compressor and to control the pressure ratio or pressure of the working fluid at compressor discharge, a slide valve is provided to the compressor and carried within a longitudinally extending recess within the barrel portions of the casing, in open communication with the bores, and partially overlying respective sides of the intermeshed screws. U.S. Pat. No. 3,088,659 to H. R. Nilsson et al and entitled "Means for Regulating Helical Rotary Piston Engine" is exemplary of the employment of such a slide valve on a helical screw rotary compressors.

Further, the longitudinal or axial position of the slide valve itself is normally controlled by a hydraulic linear motor comprising a cylinder normally an extension of the compressor casing itself, which slidably and sealably bears a piston connected to the slide valve member by way of a piston rod which extends therebetween. Further, by modulating the flow of hydraulic fluid to a closed chamber on one side of the piston, and/or by relieving fluid pressure within the chamber on the opposite side of the piston, the piston is shifted. The piston slideably moves the slide valve member relative to intermeshed helical screw rotors to thus variably control the size of a bypass opening formed between the end of the slide valve member proximate to the suction port opening to the intermeshed screw rotors, and a fixed stop. As such, a portion of the suction gas entering the working chamber as defined by the intermeshed grooves and lands of the rotors, is returned to the suction or low pressure side of the machine without compression. When the slide valve is at the point where its end face contacts the fixed stop and closes off the bypass passage, the compressor operates at 100% capacity, that is, full load. In turn, by shifting the slide valve member to its full extent away from the fixed stop and to the point where there is no cut off between the suction and discharge sides of the intermeshed helical screw rotors, no compression of the gas takes place and the compressor is operating at full unload.

Such modulating type capacity control arrangement is adequate and, in fact, highly desirable for larger helical screw rotary compressor systems and is advantageous in maximizing the efficiency of the gas compressor system. For smaller size compressors, requiring less sophisticated control arrangements, not only is there no need for such modulating capacity control, but the use of such modulating capacity control system renders the overall system unduly expensive.

It is, therefore, an object of the present invention to provide a helical screw rotary compressor with an improved slide valve capacity control system which permits operation at multiple selected load conditions which is simple, highly effective, is relatively inexpensive and which will meet most system demands required of small size helical screw rotary compressors.

SUMMARY OF THE INVENTION

The present invention is directed to stepping type slide valve unloading system for a positive displacement helical screw rotary compressor. A compressor casing is provided with a barrel portion defined by intersecting bores with coplanar axes located between axially spaced end walls and having a low pressure suction port and a high pressure discharge port in communication with the bores at opposite ends of the barrel portion. Helical screw rotors having grooves and lands are mounted for rotation within the respective bores with the lands and grooves of respective rotors intermeshed. An axially extending recess is provided within the barrel portion of the casing in open communication with the bores. A slide valve member is longitudinally slidable in the recess with the innerface of the slide valve member being complementary to the envelope of that portion of the bores of the casing structure confronted by the opening of the recess communicating with the bore portion of the casing. The valve member is in sealing relation with the confronting rotors. At least a portion of the discharge port is located within the barrel portion of the casing with the slide valve member being movable between extreme positions, with the end of the slide valve member proximate to the suction port variably closing off a bypass passage in open communication with the suction port and functioning to bypass uncompressed gaseous working fluid. The slide valve member is normally of sufficient length to cover the entire remaining length of the confronting portion of the rotor structure throughout the range of movement of the slide valve member between its extreme positions. A linear drive motor for the slide valve member comprises a cylinder, a main drive piston sealably and slidably positioned within said cylinder and a piston rod connecting the piston to the slide valve member. The piston forms, with the cylinder, an inboard chamber on the side of the piston proximate to the slide valve member, and an outboard chamber on the opposite side thereof. Means are provided for supplying and relieving hydraulic fluid pressure to at least one of said chambers for shifting the slide valve member between the extreme positions.

The improvement resides in a stepping piston carried by the linear motor and shiftable between retracted and projected positions with respect to one of said chambers to limit piston movement between the slide valve extreme positions to thereby define with the main drive piston of the linear motor, three distinct capacity control step positions for the slide valve member.

The inboard chamber may open directly to the compressor discharge port such that, absent fluid pressure application to the outboard chamber, the piston is shifted to its extreme unload position as defined by the end of the cylinder forming the outboard chamber. The cylinder is preferably provided with a cylindrical casing extension portion at its outboard end, the casing extension portion defining a stepping cylinder. A stepping piston is sealably mounted within the stepping cylinder bore and has a portion projecting from the inboard face thereof which is projectable into the outboard chamber of the main drive linear motor and being of a length such that when the stepping piston is at its extreme inboard position with respect to the slide valve member, the projection extends fully into the outboard chamber of the main linear drive motor to provide a positive stop for the linear drive motor piston, some distance from the outboard end of the linear drive motor cylinder. The system further includes means for selectively supplying hydraulic fluid pressure to the stepping cylinder outboard chamber to drive the projection portion of the piston from retracted position to projected position within the main linear drive cylinder outboard chamber and/or to the outboard chamber of linear drive motor.

The means for supplying to and relieving hydraulic fluid pressure from the outboard chambers of said main linear drive motor and said stepping cylinder may comprises a hydraulic pressure source and conduit means connecting said source of hydraulic pressure to the outboard chamber of both said main drive cylinder and said stepping cylinder and for returning hydraulic fluid from said outboard chambers to a system sump. Selectively operable valve means provided within said conduit means selectively connects each of said outboard chambers to said source of hydraulic pressure or to said sump to relatively cause said main drive piston to drive said slide valve member against said fixed stop and to maximum load condition for the compressor, or to drive said stepping cylinder piston to projected position to prevent compressor discharge shifting of said main drive piston to the end of the main drive motor outboard chamber for partially unloading the compressor or opening both the main drive cylinder and said stepping cylinder outboard chambers to the sump to permit the compressor discharge pressure to cause said main slide valve motor piston to nearly bottom out against the end of said slide valve drive cylinder, remote from the intensified screwrotors with the slide valve member of maximum unload position.

DESCRIPTION OF THE PREFERRED EMBODIMENT

Figure 1:
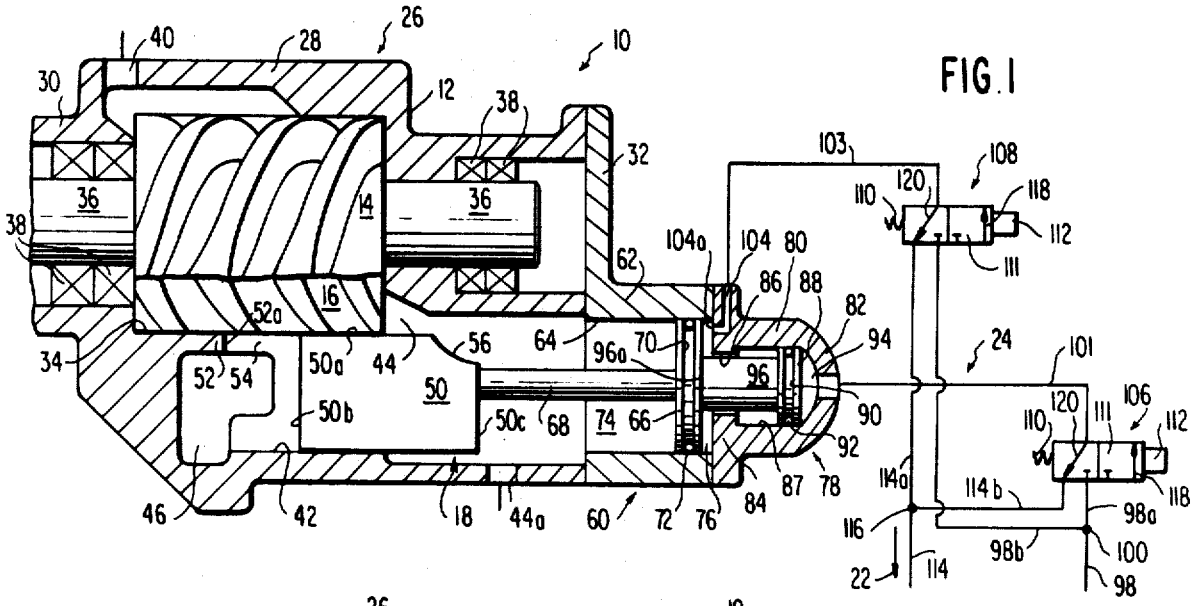
FIG. 1 is a schematic view, partially in section, of a stepping type slide valve unloading system for a helical screw rotary compressor forming one embodiment of the present invention, with the compressor operating under maximum unload conditions.

Reference to FIG. 1 shows the stepping type unloading system for a helical screw compressor forming one embodiment of the present invention. The control system has application to a helical screw rotary compressor, indicated generally at 10, comprised principally of a compressor section 12 formed by intermeshed helical screw rotors 14 and 16 and a slide valve section indicated generally at 18. The rotary drive motor for the helical screw rotary compressor is purposely not shown, although such is needed for rotatably driving one of the rotors 14, 16. Additionally, the system comprises a high pressure hydraulic fluid pressure source indicated schematically by arrow 20 and a sump for return of the hydraulic fluid or indicated by the arrow 22. Conduit means indicated generally at 24 directs the hydraulic fluid under pressure to the slide valve section 18 and the return of the same to the sump.

With respect to compressor 10, the compressor 10 comprises a casing indicated generally at 26 including a central barrel portion or section 28, of modified cylindrical form, formed of cast metal and closed off at a suction or low side end by an end bell or end wall 30. The opposite highside or discharge side is closed off by end bell or end wall 32. While not shown, the casing sections are sealed to each other by means of O-rings and the like and are bolted or screwed to each other to permit disassembly. The casing central barrel portion or section 28, located between end walls 30, 32, is provided with a compression chamber or working space formed by two intersecting bores as at 34 which bear respectively the helical screw rotors 14, 16 whose axes are coplanar and which extend, in this case, horizontally through the barrel portion 28 of the casing. The helical screw rotary compressor 10, in this respect, is conventional, and both the male and female rotors have helical lands and intervening grooves which intermesh, with the rotors mounted to rotate in the bores by means of suitable bearings, being journaled by shafts as at 36 bearing the rotors 14 and 16. Multiple anti-friction bearings 38 may be employed for mounting the shafts 36 and thus the intermeshed rotors for rotation about their axes. One shaft 36 may extend through end end wall 30 and may be directly coupled to the rotor of an electrical drive motor or the like (not shown) which act to drive the intermeshed helical screw rotors. One of the rotors functions to drive the other. The compressor casing central barrel section 28 is provided with a low pressure suction port 40 at or adjacent one end wall 30 which opens to the intermeshed helical screw rotors at that end of the machine.

The central barrel section 28 of the compressor is additionally provided with a longitudinally extending recess 42 which opens at one end to a high pressure discharge port 44 while its opposite end terminates at a bypass passage 46 which opens transversely to suction port 40. Slidably mounted within recess 42, is a longitudinally slidable slide valve member 50 sealably configured to recess 42 and bearing a peripheral portion **50*a* which faces and makes sliding contact with peripheral portions of the intermeshed helical rotors 14 and 16 and which forms a part of the envelope for the compression process occurring within working chambers defined by the intermeshed helical screw rotors 14 and 16, the casing section 28 and the slide valve member 50. Conventionally, end face 50*b* of the slide valve, proximate to the suction port 40 and thus the low side of the machine, is flat, at right angles to the slide valve member axis and abuts, when in extreme left position in the figures, a fixed abutment or stop 52. The slide valve member 50 and stop 52 define a variably sized bypass opening 54 leading from the intermeshed helical screw rotors 14 and 16 and bores 34 to the bypass passage 46. Passage 46 is connected to the suction side of the machine via casing cavity 48**.

While a portion of the opposite end face **50*c* of the slide valve member 50 is vertical and at right angles to the axis and flat, there is a peripherally relieved portion 56 of face 50*a* of the slide valve member 50 which forms with the casing, a common high pressure axial and radial discharge port 44 for the compressor, leading to compressor casing discharge port 44a**.

Conventionally, the slide valve member 50 is sealably carried within the casing section and is driven between two longitudinally displaced extreme positions. The present invention includes a modified hydraulic linear drive motor indicated generally at 60. In that respect, the end bell or end wall 32 is provided with a cylinder 62 having an internal cylindrical bore 64 coaxially aligned with the longitudinal axis of the slide valve 50. The cylinder bore 64 sealably and slidably bears a main drive piston 66 for the slide valve section 18, which piston is connected to the slide valve member 50 by way of a piston rod 68. The piston 66 is provided with a groove 70 within its periphery, bearing an O-ring or equivalent seal as at 72. The piston 66 defines with the cylinder a sealed inboard chamber 74, proximate to the slide valve member 50, and on its opposite face, to the right of piston 66, a sealed outboard chamber 76.

Unlike the prior art helical screw rotary compressors, the outboard chamber 76 is not closed off simply by an end wall or plate which spans across the open end of the cylinder 62 housing the main drive piston for the slide valve member 50. In this case, there is provided a stepping piston assembly indicated generally at 78 including a stepping piston cylinder 80 open at its left end and being closed off at its right end by spherical end wall 82. The cylinder 80 is partially closed off, at the left, by a vertical end wall 84 which extends radially beyond the periphery of the cylinder 80 to close off main drive motor outboard chamber 76, thus forming an enlarged radial flange. End wall 84 is provided with a circular opening 86 at its center which opens to the interior of the hollow cylinder 80. Cylinder 80 is formed with a circular bore 87, within which is slidably and sealably mounted a stepping piston indicated generally at 88. Stepping piston 88 is of a diameter slightly less than the diameter of the bore 87 within which it is positioned. Piston 88 bears a groove 90 within its periphery within which sits an O-ring seal 92. Piston 88 seals off outboard chamber 94 within the stepping piston cylinder 80. Integral with the stepping piston 88, is a reduced diameter cylindrical projection 96 having a diameter on the order of the circular hole 86 within wall 84 within which, the projection 96 rides.

Thus, the piston 88 is T-shaped in cross-section with an enlarged headed end interiorly of the stepping cylinder casing 80. Further, the length of the projection 96 is such that with the main drive piston 66, driven to the right, such that its face remote from the slide valve member 50 nearly contacts end wall 84 of the stepping piston assembly 78 and the projection 96 is retracted almost completely into casing 80 with its end face 96a nearly flush with the face of end wall 84. Wall 82 prevents full retraction of projection 96 from outboard chamber 76, although cylinder 80 could be lengthened to achieve this end.

In order to effect axial displacement of main drive piston 66 of the main linear drive motor 60 for the slide valve member 50, as well as independently, the projection 96 of the stepping piston 88 into the linear drive motor outboard chamber 76, the system employs means for effecting the controlled application of hydraulic pressure to chambers 76 and 94, respectively.

In that regard, the system as indicated previously is provided with conduit means at 24 for directing the flow of hydraulic fluid under pressure from a source 20 to said chambers 76 and 94 and the relief of such hydraulic pressure by return of hydraulic fluid to the sump indicated by arrow 22. Specifically, supply conduit or pipe 98 divides at point 100 such that one supply conduit portion 98a connects to one side of solenoid valve 106 while the other side 98b connects to one side of a second solenoid valve 108. Supply and return line 101 connects the other side of solenoid valve 106 to chamber 94 of stepping piston assembly 78, opening to that chamber via hole 102 within cylinder end wall 92 of that assembly.

A supply and return line 103 directs hydraulic fluid under pressure to the outboard chamber 76 of the linear drive motor for the slide valve member 50, being connected to a small diameter passage 104 within end wall 84 and opening, at port 104a, to the outboard chamber 76.

Solenoid valves 106 and 108, are two position valves. That is, the valves are spring biased by way of springs 110 to normally, absent energization of solenoids as at 112, connect lines 101 and 103 to a common sump or fluid return line 114 leading to the sump as indicated by arrow 22. Line 114 is connected via sump line 114b to valve 106, and via sump line 114a to valve 106. Movable valve members 111 within the solenoid valves permit selective communication, via passage 118, in each instance, of supply line 98 to respective supply and return lines 101 and 103 respectively. Alternatively, by way of passages 120 within movable valve members 111, and sump or return lines 114a, 114b, connection of the supply and return lines 101 and 103 is effected to the common sump line 114.

Figure 2:
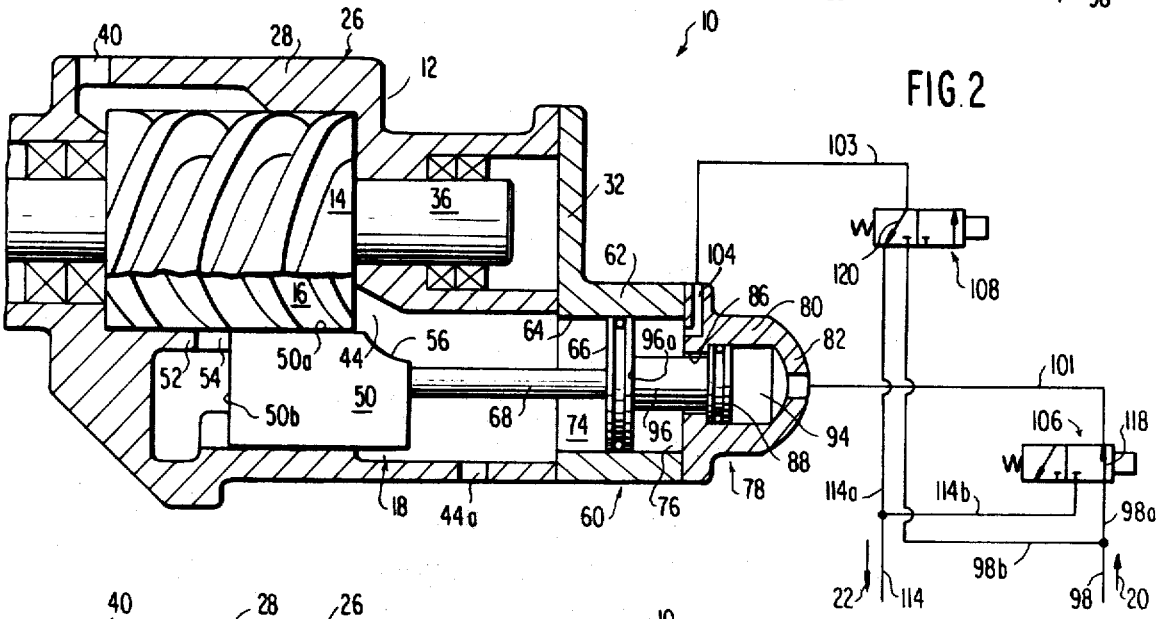
FIG. 2 is a similar view of the system shown in FIG. 1, with the slide valve member stepped to a compressor intermediate unload position.
Figure 3:
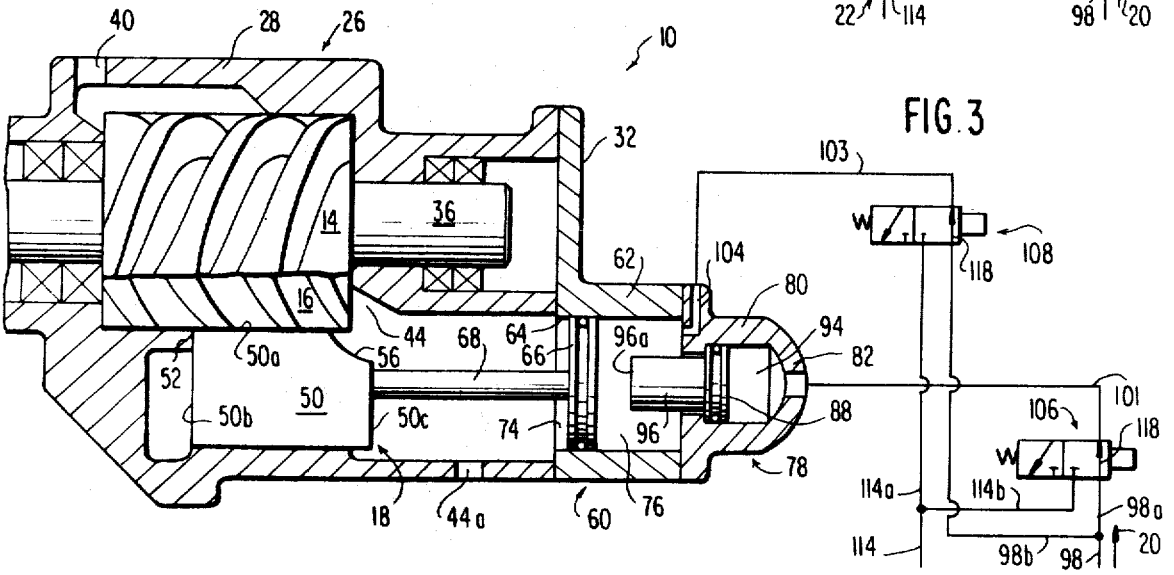
FIG. 3 is a similar view of the system of FIG. 1, with the slide valve member at compressor maximum load position.

As may be further appreciated by reference to FIG. 3, when end face 50b of the slide valve member abuts the end face 52a of stop 52, the bypass port or gap 54 is closed off and the bypass passage 46 cannot return uncompressed working fluid back to the suction side of the machine as defined by casing cavity 48. This is one extreme capacity control or loading position for the compressor. It is the full load position in the illustrated and exemplary embodiment. The maximum volume of working gas is compressed with all of the gas taken in the suction side of the machine, via port 40, being compressed at a compression ratio defined by machine parameters and being discharged under high pressure at discharge port 44 to the right of the intermeshed rotors 14, 16. Under the stepping control scheme, the slide valve member 50 steps partially to the right, FIG. 2, to the point where main drive piston 66 abuts end face 96a of the stepping piston projection 96 when it is maintained in projected position in that figure by application of fluid pressure to chamber 94. This position of the slide valve 50, FIG. 2, represents, in an exemplary fashion, two-thirds loading of the compressor. Further step unloading is permitted to the extent that the piston 66 nearly abuts end wall 84, that is, is fully displaced to the right with the stepping piston 88 near fully retracted as seen in FIG. 1. In this position bypass port or opening 54 leading to bypass passage 46 is open to its maximum with very little of the working fluid being compressed by the intermeshed rotors most being returned to the suction side of the machine prior to compression.

In normal operation, the sequence occurs from FIG. 1 to FIG. 3. Referring to FIG. 1, it is seen that the slide valve member 50 is to its extreme right position with piston 66 nearly abutting end wall 84 and displacing the projection 96 of the stepping piston 88 to the right with the stepping piston 88 adjacent end wall 82 of assembly 78. This is the position occurring at start up (or shortly after start up), where the pressure of the discharge gases filling the inboard chamber 74, displaces piston 66 to the right. The developed force acting on the main drive piston 66 is in excess of that acting on end face 50*b* of the slide valve member tending to shift the slide valve member 50 to the right within its recess 42. Further, with solenoid valves 106 and 108 de-energized, the biasing springs 110 tend to shift their movable spool members 111 to the right, thus connecting supply and return lines 101 and 103 to the common sump line 114 to drain outboard chambers 94 and 76, respectively. The compressor operates at its minimum capacity, that is, to its fullest unload capability.

In the illustrated embodiment, the step unloading (or step loading, as the case may be) is from one-third loaded condition, as shown in FIG. 1, through a two-thirds loaded condition, FIG. 2, to compressor full load condition of FIG. 3. To sequentially achieve that end, by reference to FIG. 2, it may be seen that solenoid valve 108 remains de-energized such that the outboard chamber 76 is unpressurized. With solenoid valve 106 energized however, the applied fluid pressure within outboard chamber 94 of the stepping piston assembly 78 is high enough to overcome the discharge pressure differential acting between the inboard face of piston 66 and the end face 50*b* of the slide valve member 50, such that the projection 96 of stepping piston 88 projects to its fullest extent into outboard chamber 76 of the main linear drive motor for the slide valve member 50. This effectively acts as a stop to prevent further movement of piston 66 towards end wall 84 under such conditions.

With the solenoid operated valve 106 energized, hydraulic pressure is applied as at arrow 20 to common supply line 98 and passes by way of branch line 98*a* and passage 118 within the solenoid valve spool 111 to supply and return line 101. Thus hydraulic fluid under pressure applied to chamber 94 effects the displacement of stepping piston 88 and its projection 96, to the left, FIG. 2. Meanwhile, supply and return line 103 leading to outboard chamber 76 remains connected to the common sump line 114 by way of sump return branch line 114*b* and passage 120 of spool 111 of the solenoid valve 108, which solenoid valve remains de-energized.

In order to step the slide valve member 50 to the left and to its extreme load position, and to close off bypass port 54, fluid pressure must be applied to the outboard chamber 76 of the linear drive motor to effect the displacement of piston 66 further to the left than that shown in FIG. 2 and against the discharge pressure acting within inboard chamber 74 on the opposite face of piston 66. This is achieved, FIG. 3, by energization of the solenoid valve 108 to shift the fluid connections to supply and return valve line 103 from sump line 114 to the hydraulic pressure supply line 98 via branch line 98*b* and passage 118 within the valve spool 111 for that solenoid valve.

Stepping piston 88 has the purpose of automatically creating a step unloading procedure should a reversal in operation occur, that is, with the compressor operating, if the fluid pressure applied to the outboard chamber 76 of the main drive linear motor is terminated and that chamber is open to the sump as indicated by arrow 22, while solenoid valve 106 remains energized, the compressor will simply step unload from the full load condition of FIG. 3 to a two-thirds load condition as seen in FIG. 2.

Alternatively, if solenoid valves 108 and 106 are both de-energized or if valve 106 is de-energized initially with valve 108 energized, upon termination of energization of solenoid valve 108, the system will revert to the condition shown in FIG. 1 which is at maximum unload and with the piston 66 nearly abutting end wall 84 to terminate any further movement of the slide valve member 50 to the right.

While the three steps in the loading/unloading procedure are illustrative of one set of equal capacity change steps of a typical loading or unloading sequence, the compressor may be manufactured such that the slide valve moves from full load to full unload position with a one-half unload/load intermediate stepped position for a three step sequence. Alternatively, other slide valve step positions may be effected as well as a greater number of stepped positions, determined by utilizing additional piston assemblies similar to that at 78.

While the invention has been particularly shown and described with reference to a preferred embodiment thereof, it will be understood by those skilled in the art that the various changes in form and details may be made therein without departing from the spirit and scope of the invention.

What is claimed is:

1. A stepping type slide valve unloading system for a positive displacement helical screw rotary compressor, said compressor comprising:

a compressor casing provided with a barrel portion defined by intersecting bores with coplanar axes located between axially spaced end walls and having a low pressure suction port and a high pressure discharge port in communication with said bores at opposite ends of said barrel portion, helical screw rotors having grooves and lands and being mounted for rotation within respective bores with the lands and grooves of respective rotors intermeshed, an axially extending recess provided within the barrel portion of the casing and in open communication with said bores, a slide valve member longitudinally slidable in said recess with the inner face of the slide valve member being complementary to the envelope at that portion of the bores of the casing structure confronted by the opening of the recess communicating with the bore portion of the case, said slide valve member being in sealing relation with the confronting rotors, at least a portion of the discharge port being located within the barrel portion of the casing with the slide valve member being movable between extreme positions with the end of the slide valve member proximate to the suction port variably closing off a portion of the recess in open communication with the suction port and functioning as a bypass for a gaseous working fluid, a linear drive motor for said slide valve member, said motor comprising a cylinder, a main drive piston sealably and slidably positioned within said cylinder and a piston rod connecting said piston to said slide valve member, said piston forming with said cylinder an inboard chamber on the side of said piston proximate to said slide valve member, and an outboard chamber on the opposite side thereof, and means for supplying and relieving hydraulic fluid pressure to at least one of said chambers for shifting said slide valve member between extreme positions, the improvement comprising:

a stepping piston carried by said linear motor and including a portion shiftable between retracted and projected positions into and out of one of said chambers to physically abut said main drive piston and to stop said main drive piston at an intermediate position between the slide valve member extreme positions to thereby define with the main drive piston of said linear motor, three distinct capacity control step positions for said slide valve member.

2. The system as claimed in claim 1, wherein said inboard chamber opens directly to the compressor discharge port such that absent fluid pressure application to said outboard chamber, said main drive piston is shifted to its extreme unload position as defined by the end of the cylinder forming said outboard chamber, and wherein said cylinder is provided with a cylindrical casing extension portion at its outboard end, said casing portion defining a stepping cylinder opening to said outboard chamber, and wherein said stepping piston is sealably mounted within said stepping cylinder bore, is sized to said cylinder bore and slidably and sealably positioned therein, and said stepping piston portion comprises a projection integral therewith and extending from the inboard face thereof into said linear drive motor outboard chamber and being of a length such that when the stepping piston is at its extreme inboard position with respect to said slide valve member, said projection extends into said outboard chamber of said main linear drive motor to provide a positive stop for said main linear drive motor main piston some distance from the outboard end of said linear drive motor cylinder.

3. The system as claimed in claim 2, wherein said means for supplying hydraulic fluid and pressure to at least one of said chambers comprises means for selectively supplying hydraulic fluid pressure to the stepping cylinder outboard chamber to drive the projection of said stepping piston from retracted position to projected position within said main linear drive motor cylinder outboard chamber and to the outboard chamber of said main linear drive motor to shift said main drive piston away from said projection of said stepping piston towards the opposite end of said main drive motor cylinder and into maximum compressor full load position.

4. The system as claimed in claim 3, wherein said means for supplying hydraulic fluid pressure to and for relieving hydraulic fluid pressure from at least one of said chambers comprises a hydraulic pressure source, conduit means connecting the source of hydraulic pressure to the outboard chambers of both said main drive cylinder and said stepping cylinder and for returning hydraulic fluid from said outboard chambers to a system sump, selectively operated valve means within said conduit means for selectively connecting each of said outboard chambers to said source of hydraulic pressure or to said sump to effect step unloading of said compressor, such that with hydraulic pressure supplied to the outboard chamber of said linear drive motor piston said slide valve member is driven against said fixed stop and to maximum load condition for the compressor, with hydraulic pressure applied to the outboard chamber of said stepping cylinder, said projection of said stepping piston projects into the outboard chamber of said main linear drive motor to prevent compressor discharge pressure from shifting the main drive piston to near the end of the main linear drive motor cylinder remote from said suction port and to stop said slide valve member at an intermediate load position, and with hydraulic pressure terminated within both of said outboard chambers the compressor discharge pressure causes said main linear drive motor piston to nearly bottom out against the end of said slide valve drive motor cylinder remote from said suction port of said compressor to step said compressor slide valve member to its maximum unload position.

* * * * *